US005127105A

United States Patent [19]

Sacks

[11] Patent Number: 5,127,105

[45] Date of Patent: Jul. 7, 1992

[54] PROTECTIVE GARMENT

[75] Inventor: Michael Sacks, Manchester, England

[73] Assignee: Dowty Armourshield Limited, Manchester, England

[21] Appl. No.: 688,997

[22] Filed: Apr. 12, 1991

[30] Foreign Application Priority Data

Apr. 12, 1990 [GB] United Kingdom ..... 9008458

[51] Int. Cl.[5] ..... A41D 13/00

[52] U.S. Cl. ..... 2/2.5; 2/102; 2/81; 2/85; 2/108

[58] Field of Search ..... 2/2.5, 102, 81, 108, 2/85

[56] References Cited

U.S. PATENT DOCUMENTS

| | | | |
|---|---|---|---|
| 3,055,133 | 9/1962 | Anderson | 2/102 |
| 4,266,297 | 5/1981 | Atkins | 2/2.5 |
| 4,483,020 | 11/1984 | Dunn | 2/2.5 |
| 4,485,491 | 12/1984 | Rasmussen | 2/2.5 |
| 4,507,802 | 4/1985 | Small | 2/2.5 |

FOREIGN PATENT DOCUMENTS

| | | | |
|---|---|---|---|
| 2054349 | 2/1981 | United Kingdom | 2/2.5 |
| 2089644 | 6/1982 | United Kingdom | 2/2.5 |

*Primary Examiner*—Werner H. Schroeder
*Assistant Examiner*—Gloria Hale
*Attorney, Agent, or Firm*—Young & Thompson

[57] ABSTRACT

A garment having an outer cover (1) to receive an insert (2), the outer cover (1) having a window (7) formed therein, and either the insert (2) having a label (9) that is visible through the window when the insert is inserted, thereby to indicate that the insert has been inserted and preferably to identify its protective properties, and/or the outer cover (1) having a label (11) on its inner surface opposite the window (7) so as to be visible therethrough when the insert is not inserted, thereby to indicate that the insert has not been inserted. Where the insert (2) may be inserted either way round in a correct or incorrect orientation, a label (9, 10) may be provided on either or both sides of the insert so as to indicate that the insert is correctly or incorrectly inserted in the cover when visible in the window (7).

7 Claims, 2 Drawing Sheets

PROTECTIVE GARMENT

TECHNICAL FIELD

This invention relates to garments having removable inserts to protect against ballistic attack.

It is known to provide penetration resistant inserts for garments such as vests to protect the wearer against ballistic attack. The inserts may comprise multiple layers of a penetration resistant fabric such as woven aramid fibre and a backing layer such as a polycarbonate sheet which absorbs the impact of a projectile arrested by the aramid fibre fabric. A foamed polymeric layer may also be provided behind the polycarbonate sheet to further absorb and dissipate the impact. Different inserts have different protective properties depending on the number of layers of the aramid fabric and the presence of the polycarbonate and foam layers and additional layers such as ceramic layers for maximum protection from high penetration bullets.

However, once an insert has been inserted into a garment, for example, into a pocket or cover of the garment, it is not apparent what properties the insert possesses. Indeed, in the case of a garment composed of a thick or less flexible material, it may be difficult to judge whether the garment contains an insert at all. Furthermore, it is impossible to tell whether a particular insert has been inserted the correct way round For example, the polycarbonate layer and any foam layer have to be located behind the aramid fabric layers in order to be effective in absorbing impact, and will be relatively ineffective if located in front of the aramid fabric layers. Thus, an insert inserted the wrong way round can cause a serious danger to the user of a protective garment.

DISCLOSURE OF THE INVENTION

An object of the present invention is to provide a protective garment in which the above difficulties are overcome.

This is achieved by providing a garment having an outer cover to receive an insert, the outer cover having a window formed therein, and either the insert having a label that is visible through the window when the insert is inserted, thereby to indicate that the insert has been inserted and preferably to identify its protective properties, and/or the outer cover having a label on its inner surface opposite the window so as to be visible therethrough when the insert is not inserted, thereby to indicate that the insert has not been inserted.

Where the insert may be inserted either way round in a correct or incorrect orientation, a label may be provided on either or both sides of the insert so as to indicate that the insert is correctly or incorrectly inserted in the cover when visible in the window.

DESCRIPTION OF THE DRAWINGS

The invention will now be described by way of example with reference to the accompanying drawings in which.

MODE OF CARRYING OUT THE INVENTION

Figure 1:
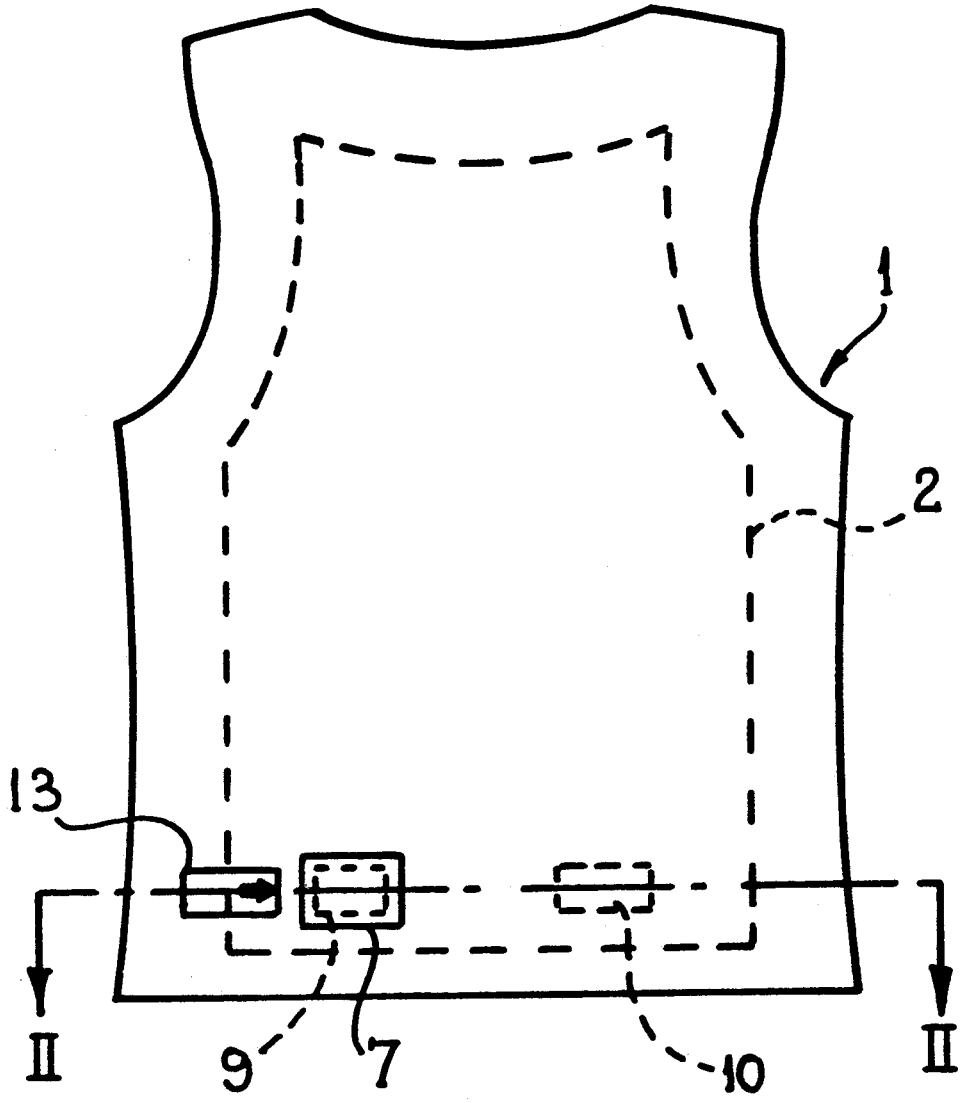
FIG. 1 shows the front panel of a bullet-proof vest according to the invention.
Figure 2:
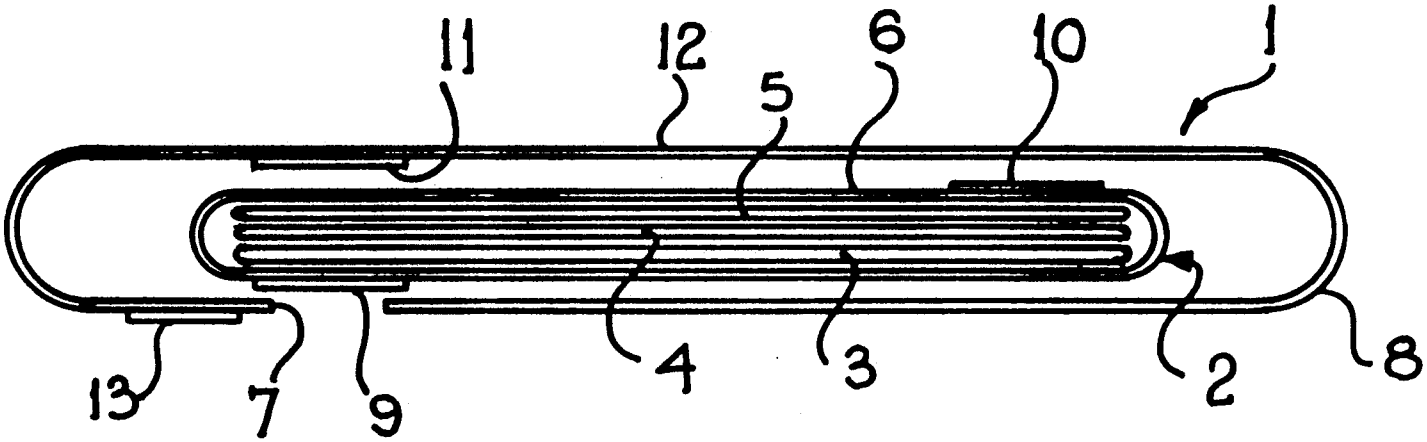
FIG. 2 shows a section along the line 2—2 in FIG. 1.

The front panel of the vest comprises a fabric cover 1 in the form of a bag or pocket into which an insert 2 can be inserted. The insert 2 comprises multiple layers 3 of woven aramid fibre fabric that are stitched together, an impact absorbing backing layer of polycarbonate sheet 4, and a layer 5 of foamed plastics such as polyethylene behind the polycarbonate sheet 4, all of these layers 3, 4 and 5 being contained in an outer cover 6.

A window 7 is formed in the outer layer 8 of the cover 1 of the vest, and a label 9 is attached to the outside of the cover 6 of the insert 2 so as to be visible through the window 7 when the insert is correctly inserted. The label serves to identify the protective properties of the insert.

A second label 10 is attached to the outside of the cover 6 on the reverse side from the label 9 so as to be visible through the window 7 when the insert is inserted the wrong way round with the polycarbonate sheet 4 and foam layer 5 in front of the aramid fibre fabric layers 3. This second label 10 serves to warn of the fact that the insert is incorrectly inserted and will not give effective protection A third label 11 is attached to the inside of the inner layer 12 of the cover 1 opposite the window 7 so as to be visible therethrough when the insert is not inserted This third label serves to warn that the insert is absent.

In an alternative embodiment of the invention, the label 11 may be omitted so that a blank window indicates the absence of an insert. In another alternative embodiment, the warning label 10 may be omitted so that the user relies entirely on the label 9 to give positive affirmation that the insert is correctly inserted. If the insert is such that it can be inserted either way round, then either the same label can be used twice on the insert or no labels are used at all on the insert, and instead the user relies entirely on the label 11 on the inside of the cover to indicate whether or not the insert is present.

A label 13 may be attached to the cover 1 adjacent the window 7 so as to indicate to the user the importance of the information appearing in the window.

It will be appreciated that whilst individual separately attached labels are used in the above illustrated embodiments, these labels may simply take the form of appropriate markings in the cover and/or insert. Further, the window 7 may simply be an open aperture or an aperture covered by transparent material.

I claim:

1. A garment comprising an outer cover to receive an insert, the outer cover having a window formed therein, and the insert having a label that is visible through the window when the insert is inserted.

2. A garment as claimed in claim 1 wherein the insert is insertable in the outer cover in either of two orientations, one orientation being a correct orientation with one side of the insert facing the window, and the other orientation being an incorrect orientation with the side opposite said one side of the insert facing the window, the label being attached to said one side of the insert and serving to indicate that the insert has been correctly inserted when visible through the window.

3. A garment as claimed in claim 1 wherein the insert is insertable in the outer cover in either of two orientations, one orientation being a correct orientation with one side of the insert facing the window, and the other orientation being an incorrect orientation with the side opposite said one side of the insert facing the window, the label being attached to said other side of the insert and serving to warn that the insert has not been correctly inserted when visible through the window.

4. A garment as claimed in claim 1 wherein the outer cover has an inner surface with a label applied to it opposite the window so as to be visible therethrough when the insert is not inserted.

5. A garment comprising an outer cover to receive an insert, the outer cover having a window formed therein and an inner surface with a label applied to it opposite the window so as to be visible therethrough when the insert is not inserted.

6. A garment as claimed in claim 1 wherein an insert is composed of a material that is resistant to ballistic attack.

7. A garment as claimed in claim 6 wherein the insert comprises a layer of material resistant to penetration and a backing layer of shock absorbing material; and is insertable in the outer cover with the shock absorbing material between the layer of material resistant to penetration and the wearer of the garment when in use.

* * * * *